United States Patent [19]

Fletcher

[11] Patent Number: 4,803,971

[45] Date of Patent: Feb. 14, 1989

[54] BOW-LIMB-OPERATED PULL-DOWN ARROW REST SUPPORT

[76] Inventor: James D. Fletcher, P.O. Box 337, Bodfish, Calif. 93205

[21] Appl. No.: 118,436

[22] Filed: Nov. 9, 1987

[51] Int. Cl.[4] ..... F41B 5/00

[52] U.S. Cl. ..... 124/41 A; 124/24 R

[58] Field of Search ..... 124/41 A, 24 R, 1, 86, 124/88

[56] References Cited

U.S. PATENT DOCUMENTS

| | | | |
|---|---|---|---|
| 2,975,780 | 3/1961 | Fisher | 124/41 A |
| 3,504,659 | 4/1970 | Babington | 124/41 A |
| 3,865,096 | 2/1975 | Troncoso, Jr. | 124/24 R |
| 3,935,854 | 2/1976 | Troncoso, Jr. | 124/24 R |
| 4,287,868 | 9/1981 | Schiff | 124/41 A |
| 4,324,221 | 4/1982 | Peck | 124/41 A |
| 4,332,232 | 6/1982 | Troncoso, Jr. | 124/41 A |
| 4,398,528 | 8/1983 | Troncoso, Jr. | 124/24 R |
| 4,407,261 | 10/1983 | Elliot | 124/41 A |
| 4,489,704 | 12/1984 | Troncoso, Jr. | 124/24 R |

*Primary Examiner*—Randolph A. Reese
*Assistant Examiner*—Anthony Knight
*Attorney, Agent, or Firm*—Henry M. Bissell

[57] ABSTRACT

A pull-down type arrow rest support for an archery bow is disclosed. The downward motion of the lower limb tip as the bow changes from its drawn position to its relaxed position is used to pull down the arrow rest support out of the path of the arrow. There is no need for cocking the device each time before an arrow is fired, and the pulled-down arrow rest support clears even the largest fletchings so that the arrow is not deflected from its intended path. The arrow rest support disclosed makes it possible to use a V-spool rest or can be adapted to use other commercially available arrow rests. Provisions are made for precise vertical and horizontal adjustments of the arrow position, and the V-rest can be adjusted to accommodate any size arrow.

13 Claims, 2 Drawing Sheets

BOW-LIMB-OPERATED PULL-DOWN ARROW REST SUPPORT

BACKGROUND OF THE INVENTION

1. Field of the Invention.

This invention relates to archery and, more particularly, to an arrow rest support which is pulled down by action of the bow limb when the arrow is released.

2. Description of the Related Art.

The shooting of arrows with a bow is a skill practiced by man that dates from prehistoric times. The bow in its various forms was for a long time a principal weapon of war and of hunting throughout the world. Proficiency in the use of the bow involved many of the features associated with a sport—practice to achieve accuracy or increased distance, the development of skill in aiming and releasing the arrow, the element of competition, and the satisfaction of skilled performance under pressure. Although in the 15th century the bow was superseded as a weapon of war, it remained in use as a hunting weapon and for recreational activities. Since that time the activities associated with the bow have evolved into the modern sport of archery. By the 1970s, the total number of participants in all forms of the sport was about 8 million in the United States alone. Of these participants, a relatively small number strive for ever greater distances in "flight" shooting, a much larger number are concerned with accuracy in shooting at targets of various kinds at specified distances, and a still larger number have adopted the bow as their primary weapon for hunting game.

The bow was with little doubt the first mechanical device that allowed the achievement of hurling a projectile with more speed than was possible by throwing. It accomplishes this by storing energy in the bow limbs while the bow string is drawn, keeping it stored during the aiming process, and converting the stored energy during release of the bow string into energy of flight of the arrow. Its invention, thirty thousand or more years ago, easily ranks in importance with the invention of the wheel and the capability of creating fire. Evidence that the bow was known as an effective hunting weapon thousands of years ago is demonstrated by rock paintings in caves in Eastern Spain.

During its protracted history the bow has taken many shapes and sizes and has assumed various structures. Artisan bowyers used their ingenuity to develop variations from the primitive early prototypes. For example, various natural materials such as wood, horn, sinew, gut, and rawhide were found to be especially suited to the purpose of making a device that would enable an arrow to be sent towards its mark at the will and under the control of the archer.

Initially bows were made of one material, usually wood (self bows). Later bows were made of several materials, such as wood, horn, and sinew, glued together in layers (composite bows). Short self bows were used in Europe up until the 11th century. The longbow, originally also a self bow, apparently originated in Wales. Its length was about the same as the height of the archer, and the arrow about half as long. The bow was held with outstretched arm and the arrow drawn to the ear of the bowman.

The limbs of the modern bow are composite and laminated to give exceptional strength in both compression and tension. A long, rigid middle section provides mass and stability which contribute to accuracy; its length compensates for the relatively short limbs, which contributes to the desirable action that is the hallmark of the longbow. The string is as light and strong as possible and is usually made of a synthetic fiber.

From the time of release until the arrow leaves the string, the force exerted on the bow includes one that tends to rotate the bow about an axis parallel to the string, the axis passing through the hand holding the bow. Any rotation of the hand produces a small lateral error in air. Various stabilizing schemes are used to increase the moment of inertia about the axis of rotation referred to, thus lessening the effect of the rotational impulse imparted to the bow when the arrow is released and reducing the lateral dispersion of hits on the target.

The materials used for making arrows must have such desirable characteristics as strength, stiffness, and resilience consistent with minimum weight. Uniformity in the mechanical and elastic properties of the arrow shafts is highly desirable. The stabilizing vanes, traditionally feathers and in modern times plastic fins, are known as the "fletching," and must be the same and attached in the same location and configuration on all the shafts.

Modern target arrows are generally made of metallurgically treated aluminum alloy tubing with close tolerances on diameter and wall thickness. Arrows can be made very closely alike from such tubing. To reduce drag, plastic vanes are usually used, and the surface of the arrow is given as smooth a finish as possible. The plastic fins are cemented onto the shaft in a jig so that they have identical flight characteristics.

The so-called Mediterranean draw is used to draw and loose the arrow. This type of draw is executed by drawing the string with three fingers, the first above and the second and third below the nocked arrow. In right-handed shooting, the arrow rests on an arrow rest on the left side of the bow. Various devices have been designed to aid in drawing and loosing the arrow. They have permitted marked improvement in accuracy.

Various factors related to the manner in which the bow and arrow interact during the small period of time between the release and departure of the arrow from the string affect the subsequent flight of the arrow. One such factor is the collision of the fletching with the arrow rest as the arrow leaves the bow. Any contact between the fletching and the arrow rest can cause a deflection of the arrow from its intended path.

Various types of conventional arrow rests are described in U.S. Pat. Nos. 4,332,232, 3,865,096, 3,935,854, 4,398,528, and 4,489,704.

Two arrow rest holders currently on the market can be described as pull-down or fall-down arrow rest holders. One uses the recoil of the bow to move a small weight to release a spring-loaded device. The arrow rest is forced down and out of the path of the fletching so as not to deflect the arrow from its intended path. This device must be cocked before each shot. The second device has a rubber tube attached to the device and to the bow cables so that when the bow is drawn, the rubber tube pulls the device up into shooting position and when the arrow is fired the arrow rest is allowed to fall. Other such devices may be available, but basically they all use gravity or a spring of some sort to pull them down. Because the arrow moves at about 200 feet per second when the arrow rest begins to fall, it is difficult to find a spring that can move fast enough so that the fletching does not hit the arrow rest as it is being pulled down. Any contact between the fletching and the arrow rest as it is being pulled down results in a deflection of the arrow. In addition to the deficiencies of presently available arrow rest holders of the fall-down or pull-down type with respect to failure to clear the arrow fletching, most of these devices have to be cocked before each shot.

SUMMARY OF THE INVENTION

Arrangements in accordance with the present invention comprise an improved arrow rest support of the pull-down type. The downward motion of the lower limb tip as the bow changes from its drawn position to its relaxed position is used to pull down the arrow rest support out of the path of the arrow. The arrow rest support is able to rotate about a horizontal axis against the restoring torque of a small spring. One end of a cable is fastened to the arrow rest support and the other to the lower limb tip of the bow. With the bow in its relaxed position, the cable length is adjusted so that the arrow rest support is held down about ½ inch below the position it assumes when the bow is drawn and ready to fire. As the bow is drawn, the lower limb tip moves upward and the cable relaxes to allow the rest support to move up by spring tension until an adjustable screw is stopped by a pin. The device is then in the firing position. When the bowstring is released, the arrow is propelled forward supported by the spring-loaded arrow rest, a V-grooved spool in the preferred embodiment. The arrow rest is attached behind the bow handle so that it can rotate about 100° to a straight-down position, at which point it is stopped by a rubber bumper.

During the last ½ inch to one inch of limb tip travel, the rest support is jerked down at tremendous speed, overcoming the restoring force of the support spring and continuing through the approximate 100° arc until it is slowed down by the spring force and stopped by the rubber bumper. It then rebounds through the 100° arc and is stopped in the beginning arrow-loading position by the cable.

The arrow rest holder of the present invention will clear the largest hunting vanes and makes it possible to use a simple arrow rest such as a V-spool which it is not possible to use on any other type of rest support. The arrow rest of the present invention may be used with the fingers or with a release aid. It can be adapted to practically all bows on the market and will accommodate heavy hunting arrows. It can be made for either left- or right-hand bows. It can also be made in an overdraw model by extending the rotating parts of the support towards the rear rather than towards the front of the bow.

Precise vertical adjustment of the arrow is controlled by a vertical adjustment set screw in the arrow rest support. The width of the groove in the V-spool can be adjusted by positioning two parts making up the spool, two beveled rubber bushings which are on a threaded rest screw. The horizontal position of the V-spool rest is also adjustable by screwing the rest screw into or out of the support. This rest support is attached to the bow by a 5/16 inch bolt threaded into the standard arrow rest attachment of a bow. Unlike other pull-down or fall-down rest supports in which the arrow rest falls down and stops inside and on the bow window shelf, the present device is pulled completely below the shelf to allow the total window area for vanes or fletching passage without obstruction to cause deflection of the arrow. The spool width is adjustable by moving two beveled rubber bushings on a threaded screw. The rotatable part of the arrow rest support must be located behind the bow window rather than protruding into it as most shoot-through arrow rests do. This placement of the rest support also creates the desirable overdraw that many archers prefer.

BRIEF DESCRIPTION OF THE DRAWING

A better understanding of the present invention may be realized from a consideration of the following detailed description, taken in conjunction with the accompanying drawing in which.

DESCRIPTION OF THE PREFERRED EMBODIMENT

Figure 1:
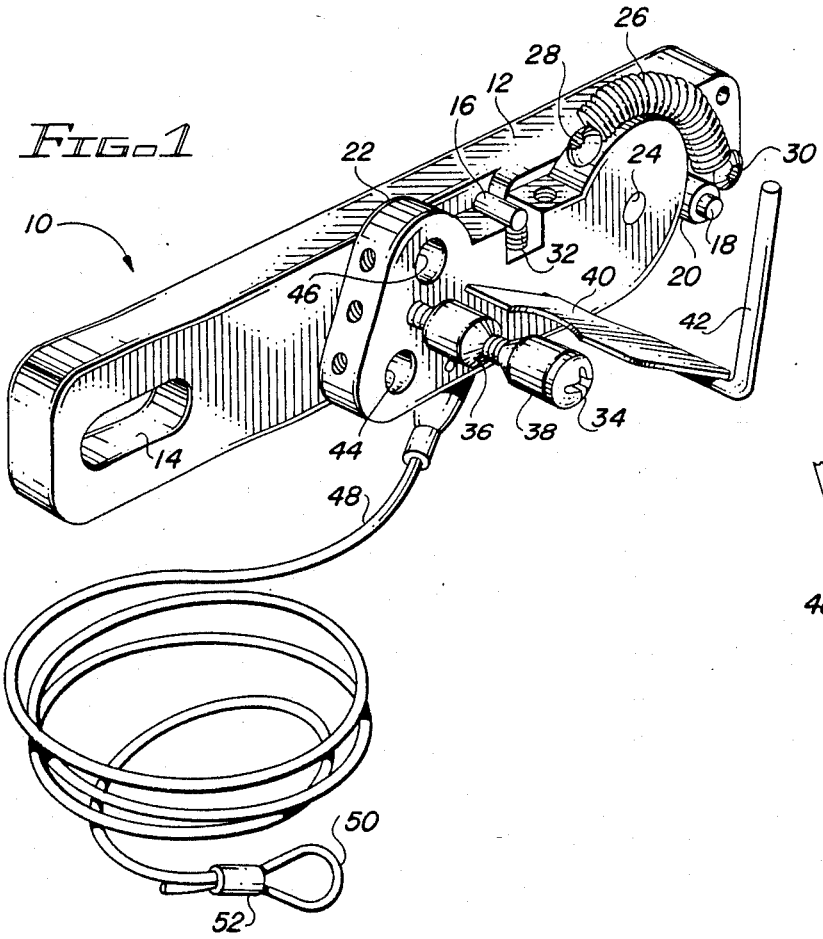
FIG. 1 is a perspective view of the arrow rest support of the present invention in isolation.

Referring to FIG. 1, a pull-down arrow rest support 10 in accordance with the teachings of the present invention is shown in a perspective view. An attachment piece 12 has a slotted hole 14 through it which enables the arrow rest support 10 to be attached to the standard arrow rest attachment of a bow, as for example by a 5/16 inch bolt. A pin 16 extends from one side of attachment piece 12 near the top center thereof. A post 18 covered by a bumper bushing 20 also extends from attachment piece 12 at substantially right angles to it. A support piece 22 is rotatably attached to attachment piece 12 by means of a shaft 24 which is fixed in support piece 22 but free to rotate in a hole through attachment piece 12. A spring 26 is hooked at one end to a first spring screw 28 in support piece 22 and at another end to a second spring screw 30 in attachment piece 12.

As shown in FIG. 1, spring 26 is in tension. An adjustment screw 32 which is screwed into a threaded hole in support piece 22 is held by the spring tension against pin 16 in attachment piece 12. An arrow rest consists of a rest screw 34 with first and second beveled bushings 36 and 38 on a threaded part of the screw. Bushings 36 and 38 provide a V-shaped groove on which to rest an arrow. The width of the groove can be adjusted by moving beveled bushing 36 toward or away from beveled bushing 38. Rest screw 34 can be screwed into or out of a threaded hole in support piece 22 to vary the position of the V-shaped groove on which an arrow rests.

An arrow guard attached to support piece 22 adjacent rest screw 34 consists of a thin plate portion 40 having a semicircular cutout to clear the shaft of an arrow when it rests on the V-shaped groove provided by first and second beveled bushings 36 and 38, and an L-shaped rod 42. The purpose of L-shaped rod 42 is to catch an arrow should it fall off the arrow rest. Plate portion 40 is fixed to L-shaped rod 42 which in turn is attached to support piece 22. Adaptor holes 44 and 46 through support piece 22 on either side of rest screw 34 provide the capability of using some sort of conventional arrow rest other than the one shown. A cable 48 is attached at one end to support piece 22 and is formed into a loop 50 by means of a crimped metal piece 52 at its other end.

Figure 2:
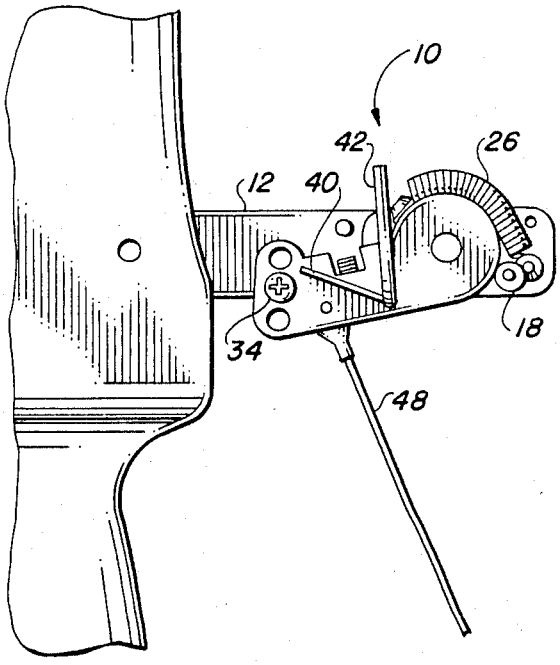
FIG. 2 is a side view of the arrow rest support attached to part of a bow which is in its relaxed position.

FIG. 2 shows a side view of the arrow rest support 10 attached to a bow in its relaxed state, ready for an arrow to be loaded. The length of cable 48 is adjusted so that cable 48 is taut when attached to support piece 22 at one end and to the limb tip of the bow at the other end when the bow is in its loading position. The tautness is supplied by the tension in spring 26, with support piece 22 held down preferably about half an inch below the position it will have when the bow is drawn and ready to fire. As can be seen in FIG. 2, support piece 22 has been rotated counterclockwise against the tension of spring 26 so that adjustment screw 32 is not in contact with pin 16.

Figure 3:
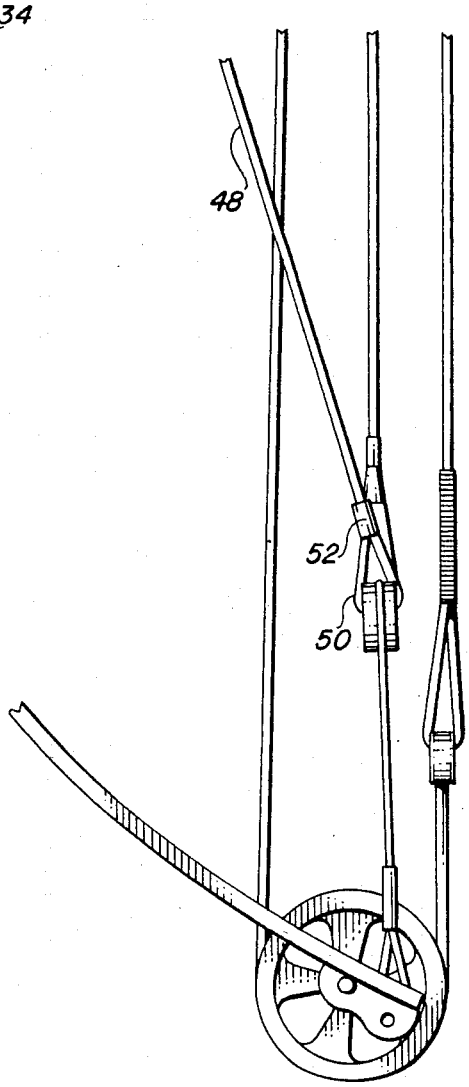
FIG. 3 is a side view of the lower part of the arrow rest support cable attached to a standard bow limb harness when the bow is in its relaxed position.

FIG. 3 is a side view of the bottom limb of a bow with a standard harness to which the lower end of cable 48 is attached. The bow is in its relaxed state in FIG. 3 prior to an arrow being loaded.

Attachment piece 12 and support piece 22 can be fabricated out of any suitable material such as metal or plastic. First and second beveled bushings 36 and 38 are preferably made of a material exhibiting a low coefficient of friction in combination with the material out of which the arrow is constructed. One such material is the plastic Teflon. In hunting applications, for example, it is desired that there be no noise associated with the movement of the arrow against the arrow rest as the bow is drawn. Bushing 20 can be of rubber or any other suitably resilient material. A suitable material for cable 48 would be monofilament nylon of sufficiently large diameter.

Figure 4:
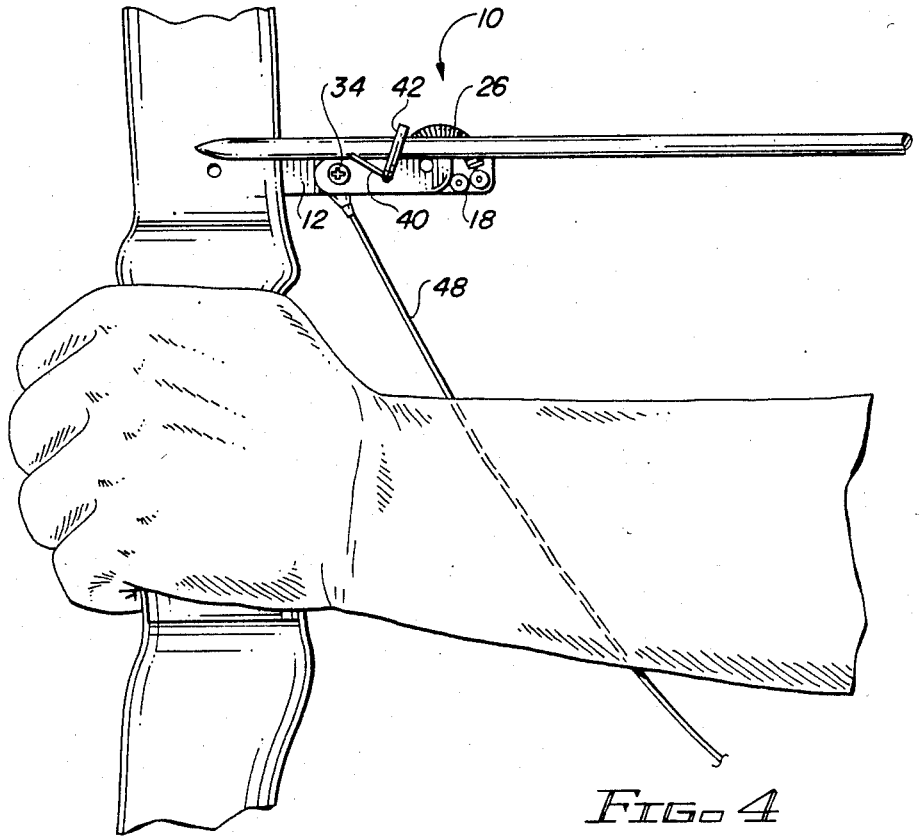
FIG. 4 is a side view of the arrow rest support on a fully drawn bow with an arrow about to be fired.
Figure 5:
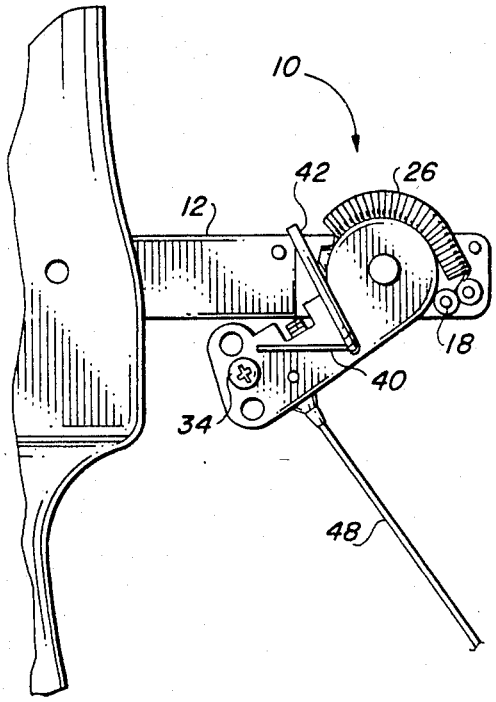
FIG. 5 is a side view of the arrow rest support moving downward after release of the arrow.
Figure 6:
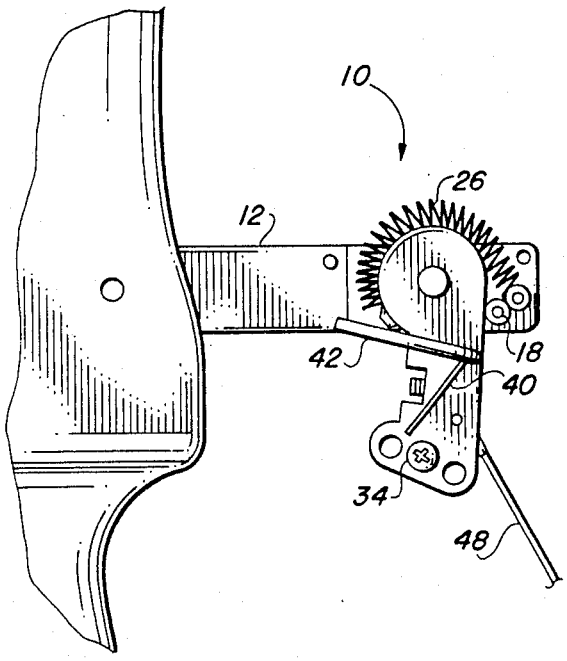
FIG. 6 is a side view of the arrow rest support rotated through its full arc of motion and ready to return after firing of an arrow.

The sequence of positions assumed by support piece 22 as the bow is drawn and after the arrow is fired is illustrated by FIGS. 4, 5, and 6. In FIG. 4 an arrow 54 rests on the arrow rest composed of first and second beveled bushings 36 and 38 when the bow 56 is in its fully drawn state. Cable 48 is slack because the lower limb of bow 56 has moved upwards as the bow string is drawn. Since cable 48 is slack, support piece 22 assumes the same position as is shown in FIG. 1, with adjustment screw 32 in contact with pin 16. The tension in spring 26 tending to rotate support piece 22 clockwise holds adjustment screw 32 in contact with pin 16.

FIG. 5 shows support piece 22 of arrow rest support 10 moving downward after an arrow has been released. The force causing counterclockwise rotation of support piece 22 is supplied by the motion of the lower limb of the bow after the bow string is released. As the lower bow limb moves downward toward its relaxed position, support piece 22 is pulled by cable 48 so as to rotate it on shaft 24. The rotation continues until the bottom edge of support piece 22 contacts bushing 20 on post 18. The position of maximum counterclockwise rotation of support piece 22 is shown in FIG. 6. Support piece 22 rebounds with a clockwise rotation after contact with bushing 20, in response to the restoring tensional force in spring 26.

The sequence of events in the operation of the arrow rest support 10 of the present invention is as follows. The loading position of support piece 22 corresponds to the condition of the bow when the bow string is not drawn. Given a particular spring constant for the spring 26, the length of the cable 48 connecting support piece 22 with the lower bow limb determines the amount of rotation of support piece 22 away from the position it would assume were cable 48 slack. When an arrow is loaded by resting it on the arrow rest and drawing the bow string, cable 48 slackens because of the upward change in position of the lower bow limb tip. In this drawn condition of the bow, the tension in spring 26 rotates support piece 22 so that adjustment screw 32 is in abutting contact with pin 16 on attachment piece 12. When the bow string is released, the arrow is propelled forward supported by the spring retained arrow rest, the V-groove between the beveled edges of bushings 36 and 38. During the last half inch to one inch of limb tip travel, the support piece 22 is jerked downward at high speed by the motion of the lower limb tip to which cable 48 is attached. Support piece 22 continues to rotate through the approximate 100° arc by inertia until it is slowed by the spring 26 and stopped by the bumper 20 on post 18. Support piece 22 then rebounds backwards through the 100° arc and is stopped in the initial arrow loading position by cable 48.

The arrow rest support of the present invention is simple to build and is a great improvement over any commercially available arrow rest support of the fall-down or pull-down type. It does not have to be cocked before each shot as most of the commercially available types require. In contrast to the commercially available rest supports, the support of the present invention absolutely clears the fletching because of the great speed with which it is pulled down by the lower limb tip after the bow string is released. Even the largest hunting vanes are cleared, and it is possible to use the simplest arrow rest such as the V-spool, which it is not possible to use on any other arrow rest support. An arrow rest support according to the present invention may readily be used with fingers or with a release aid. It is adaptable to practically all bows on the market and will handle heavy hunting arrows. It can be constructed for either left or right hand bows. It may also be made in an overdraw model by extending the support piece 22 away from rather than toward the bow.

A unique feature of the arrow rest support of the present invention is that when the bow limb tip jerks the support piece downward and the limb has reached its farthest point after firing, the support piece 22 keeps moving until it hits bumper 20 and then is returned to its original position. The very quick downward start of support piece 22 assures that the arrow rest will be clear of the arrow fletching before it passes, and the long inertia-driven arc and slow spring return assure that the arrow rest is down and clear while the arrow fletching is passing through.

The arrow rest support 10 is adjustable in several ways. It may be adjusted very precisely by vertical adjustment screw 32 in support piece 22 and horizontally by moving rest screw 34. It is also possible to adjust the width of the V-groove of the arrow rest to fit any diameter arrow by moving first beveled bushing 36 on the threaded portion of rest screw 34.

The arrow rest support 10 of the present invention is a very durable device. Even when the limb tip jerks downward it has only the small resistance of spring 26 to overcome, and when support piece 22 moves further downward, cable 48 becomes slack and allows the limb tip to move past its rest position because of stretch in the bow string. With the present device there is never a hard jerk on the stationary parts of the rest support that could move it out of its set position.

Although there has been described above one specific arrangement of an arrow rest support in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A pull-down arrow rest support for an archery bow comprising:

attachment means for attaching said arrow rest support to said bow;

support means attached to said attachment means for supporting an arrow;

elastic restoring means for holding said support means in first and second positions corresponding to relaxed and drawn states of said bow, respectively; and retracting means for holding said support means in said first position when said bow is relaxed and for moving said support means away from the path of said arrow as it is being fired;

continuously and smoothly horizontally adjustable and width-adjustable rest means on said support means for adjusting a position of said arrow with respect to its horizontal distance from said attachment means and for accommodating different sized arrow shafts;

continuously and smoothly adjustable upper limit means for limiting the height of said support means when it is in said second position;

stop means for limiting the range of motion of said support means between said first position and a third position; and guard means to the rear of said rest means on said support means for catching said arrow should it fall off said support means.

2. The arrow rest support of claim 1 wherein said rest means comprise first and second means for supporting said arrow therebetween and for providing a minimum of friction against said arrow as it is being fired.

3. The arrow rest support of claim 1 in which said retracting means is connected to a limb end of said bow so that said limb end moves said support means from said second position to said first position, corresponding to said drawn and relaxed states of said bow.

4. The arrow rest support of claim 3 in which said retracting means comprises a cable having a first end attached to said support means and a second end attached to a harness attached to said limb end of said bow.

5. An arrow rest support for an archery bow comprising:

an attachment member adapted to be attached to said bow;

a stop member fixed to said attachment member and extending to one side thereof;

a support member pivotally attached to said attachment member having a rest part on which said arrow rests and having a threaded hole in a top part;

a spring member connecting said attachment member with said support member, said spring member being in tension when said bow is in a relaxed or drawn condition;

a cable member having a first end attached to said support member and a second end connected to a limb tip of said bow, said cable member holding said support member in a first position against the tension of said spring member when said bow is in a relaxed state;

an adjustment screw screwed into said threaded hole in said top part of said support member which contacts said stop member when said support member is held in a second position under the tension of said spring member, corresponding to said bow being in a drawn condition;

a guard member attached to said support member and extending laterally therefrom to one side of said support member;

a bumper post attached to said attachment member and extending laterally therefrom on the same side as said support member and adjacent thereto; and a bumper on said bumper post;

wherein the length of said cable member is adjusted so that said support member is held down against the spring tension of said spring member in said first position when said bow is in a relaxed state; when said bow is drawn said limb tip moves up, thereby slackening said cable member and letting said support member move up by spring tension until said adjusting screw in support member is stopped by said stop member in said second position which is the firing position; upon firing, said arrow is released and propelled forward supported by said support member, said support member being located on said bow so that it may rotate about 100° to a straight-down position, where said support member is stopped by said bumper; said support member is jerked down at tremendous speed during the last half inch to one inch of travel of said limb tip, said support member being retracted from the path of said released arrow so that the fletching on the end of said arrow does not strike said support member and said arrow is not deflected from its intended path.

6. The arrow rest support of claim 5 wherein said rest part of said support member comprises:

a rest screw having a threaded portion and a head;

a first bushing having a bevel on one end thereof on said threaded portion of said rest screw flush against said rest screw head;

a second bushing having a bevel at one end thereof, said second bushing being located with its beveled end facing the beveled end of said first bushing, said bevels forming a V-shaped groove with said threaded portion of said rest screw at the bottom thereof; and wherein said support member has a first threaded hole therethrough into which said rest screw can be screwed, and a second threaded hole transverse to said first threaded hole and communicating therewith; and a set screw in said second threaded hole for fixing the lateral position of said rest screw.

7. The arrow rest support of claim 5 in which said guard member comprises:

an L-shaped rod having one end adapted for insertion into a hole in said support member, and another end oriented with respect to said support member so that an arrow falling off said rest part is restrained from falling to the ground; and a thin plate part fixed to said L-shaped rod, having a semicircular cutout portion so that said arrow clears said plate while resting on said rest part; and set screw means for attaching said guard member to said support means in a variety of orientations with respect to said support means.

8. The arrow rest support of claim 5 in which said attachment member has a slotted hole through which a 5/16 inch bolt may be screwed into a standard rest attachment hole of said bow.

9. The arrow rest support of claim 5 in which said support member has first and second adaptor holes therethrough parallel to and adjacent said rest part, each said adaptor hole communicating with a transversely drilled and tapped hole for a set screw, said first and second adaptor holes being adapted for attachment of arrow rests other than said rest part.

10. The arrow rest support of claim 5 wherein said cable member comprises nylon monofilament having a loop portion at one end formed with a crimped metallic piece and having a lug portion at another end with a hole therethrough; said lug portion being adapted for retention by a screw screwed into a threaded hole in said support member, and said loop portion being adapted for connection to said bow limb.

11. The arrow rest support of claim 5 wherein said support member and said attachment member are pivotally connected by means of a shaft fixed in a hole in said support member, said shaft extending through a hole in said attachment member and being free to rotate with respect to said attachment member.

12. The arrow rest support of claim 5 wherein said spring member is a helical spring attached at one end to said support member and at another end to said attachment member in such a way that said spring is in tension when said support member is in either said first or second positions.

13. The arrow rest support of claim 5 wherein said second end of said cable member connects to said bow limb through a part of a harness.

* * * * *